United States Patent [19]

Schweitzer

[11] Patent Number: 4,613,094

[45] Date of Patent: Sep. 23, 1986

[54] TREAD ROLLER APPARATUS

[76] Inventor: William K. Schweitzer, 35045 Mustang, Sterling Heights, Mich. 48077

[21] Appl. No.: 718,797

[22] Filed: Apr. 1, 1985

[51] Int. Cl.[4] ..... B65H 18/16; B65H 75/42

[52] U.S. Cl. ..... 242/86.52; 414/621; 414/911

[58] Field of Search ..... 242/86.52, 86.5 R, 86.6, 242/86.64, 86.7, 94, 86.4; 100/76, 86, 88; 56/341; 414/608, 621, 624, 684, 686, 785, 911

[56] References Cited

U.S. PATENT DOCUMENTS

| | | | |
|---|---|---|---|
| 2,393,655 | 1/1946 | Robeck . | |
| 2,536,571 | 1/1951 | Sanguin et al. . | |
| 2,569,589 | 10/1951 | Trissell | 242/58 |
| 2,923,487 | 2/1960 | Wands et al. | 242/55.1 |
| 3,410,431 | 11/1968 | Vik | 414/621 X |
| 3,632,054 | 1/1972 | Heppelmann | 242/86.5 R |
| 3,880,305 | 4/1975 | Van Polen | 242/86.52 X |
| 3,913,854 | 10/1975 | McClure | 242/86.52 X |
| 4,056,241 | 11/1977 | Yates | 242/86.4 |
| 4,082,192 | 4/1978 | Cox | 242/86.5 R |
| 4,084,763 | 4/1978 | Zamboni | 242/86.52 |
| 4,354,556 | 10/1982 | Evans | 242/86.52 X |
| 4,394,052 | 7/1983 | Adams et al. | 242/86.52 X |
| 4,514,127 | 4/1985 | Maier | 242/86.5 R |

FOREIGN PATENT DOCUMENTS

| | | | |
|---|---|---|---|
| 1021197 | 11/1977 | Canada | 56/341 |
| 1218647 | 1/1971 | United Kingdom | 56/341 |

*Primary Examiner*—John M. Jillions
*Attorney, Agent, or Firm*—Burton, Parker & Schramm

[57] ABSTRACT

Apparatus for forming a tread, such as a tank or earth moving equipment tread, into a roll for transport. First and second support members are mounted on a vehicle, such as a forklift truck. A blade having an inclined, tapered front portion is movably mounted on one of the support members and releasably engages the opposite support member to engage the tread and urge the end of the tread into a roll as the vehicle is moved over the tread. A roller is mounted between the support members rearward of the blade to urge the end of the tread into a roll. Pins mounted on the support members are movable into the center of the tread roll to support the roll above the ground for transport. Lock means are provided for the pins in either of the first or second positions.

10 Claims, 8 Drawing Figures

TREAD ROLLER APPARATUS

BACKGROUND OF THE INVENTION

1. Field of the Invention

The present invention relates to devices for rolling up a tread such as used on a military tank or heavy earth moving equipment into a roll for easy transport.

2. Description of the Prior Art

Certain vehicles have been designed to operate in an off-the-road environment, such as military tanks and heavy earth moving equipment, such as bulldozers, etc. To provide effective movement of such vehicles on the ground which may be soft, muddy, etc., such vehicles are provided with treads in the form of a series of interconnected earth engaging pads which are driven around a series of aligned road wheels mounted on opposite sides of the vehicle. Due to the size and weight of such vehicles, the treads are extremely long and, of necessity, heavy. Typically, such threads exceed two tons in weight.

During initial assembly of the vehicle and also during subsequent repair and/or replacement of the threads, it is necessary to move the treads between a storage location and the vehicle. Due to the weight of each tread, such movement is a difficult and time consuming task. Typically, the tread is broken down into smaller sections which can be more easily handled by conventional equipment, such as forklifts, trucks, etc. However, such disassembly and re-assembly merely increases the amount of time required to install and/or remove a tread from the vehicle. What is needed is a device which provides easier handling and movement of a tread between various locations. It is to this end that the present invention is directed.

SUMMARY OF THE INVENTION

The present invention is an apparatus for forming a tread, such as a tread utilized on a military tank or heavy earth moving vehicle, into a roll for easy transport or movement between storage and use locations.

The apparatus includes first and second support members which are mounted on a movable vehicle, such as a forklift truck. A blade having an inclined, tapered front end is movably mounted on one end of one of the support members and is releasably engagable with one end of the opposite support member. The blade is adapted to engage the tread and cause it to curl onto itself into a roll.

At least one and preferably two rollers are mounted on the vehicle rearward of the blade and urge the tread back over itself to form a roll as the vehicle is moved forward along the length of the tread. First and second pin members are mounted on the support members and are movable into the center opening formed in the tread roll to support the tread roll off of the ground during transport of the roll. Locks are provided for locking the pins in a storage position overlaying the support members and an extended position within the center of the tread roll.

The tread roller apparatus of the present invention overcomes many of the problems encountered with previously devised apparatus and methods for handling treads utilized by military vehicles or heavy earth moving equipment. The apparatus of the present invention provides a convenient, quick and safe mechanism for rolling the tread into a roll prior to its movement between storage and use locations. This eliminates the time consuming procedure normally employed in which the tread is broken down into smaller sections for more easily handling by conventional equipment, such as forklift trucks, etc.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
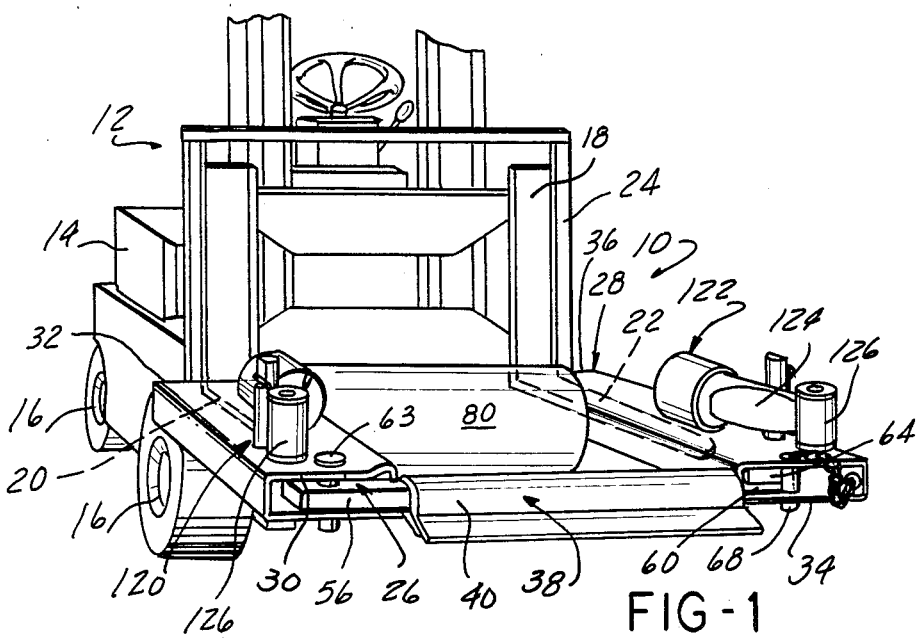
FIG. 1 is a perspective view of the tread roller apparatus of the present invention.

Throughout the following description and drawing, an identical reference number is used to refer to the same component shown in multiple figures of the drawing.

Figure 7:
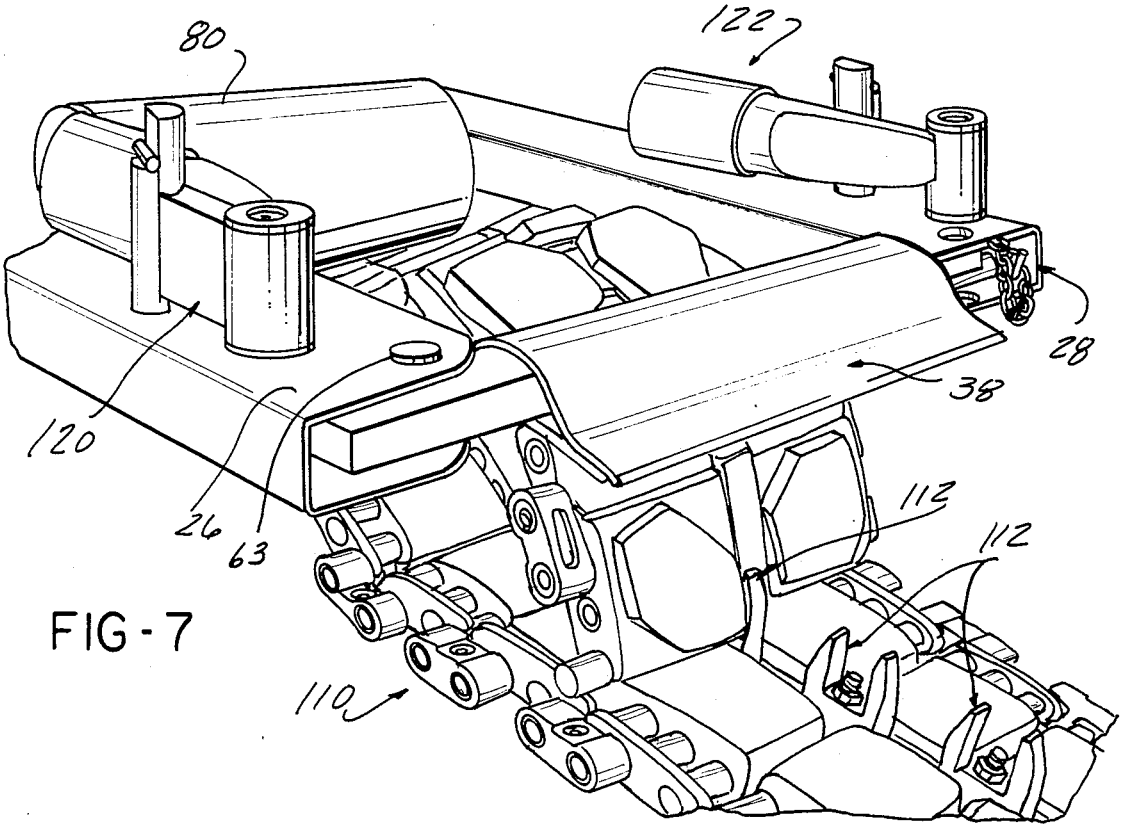
FIG. 7 is a perspective view showing the use of the tread roller apparatus in initially forming the tread into a roll.

Referring now to the drawing and, in particular, to FIGS. 1 and 7 there is illustrated a tread roller apparatus 10 which is useful in forming a tread 110 such as those commonly employed on military tanks and heavy earth moving equipment such as bulldozers, into a roll for convenient transport between storage and use locations. By way of example only, the tread roller apparatus 10 is mounted on the front end of a forklift truck 12. It will be understood, however, that other vehicles, such as tanks, earth moving equipment, etc., may also have the tread roller apparatus 10 mounted thereon.

As shown in FIG. 1, the vehicle 12 is a conventional forklift truck having a body 14, wheels 16 and a movable arm section 18. As is conventional, the forklift truck 12 is provided with first and second outwardly extending forks 20 and 22 which are mounted on a carriage or track 24. Drive means, such as a hydraulic cylinder, not shown, is mounted on the forklift truck 12 for moving the forks 20 and 22 vertically up and down along the track 24.

The tread roller apparatus 10 of the present invention includes first and second support members or arms 26 and 28, respectively. The first and second support members 26 and 28 are mounted on the forks 20 and 22, respectively, of the forklift 12 by suitable fasteners or by welding. The support members 26 and 28 thus extend outward from the front end of the forklift truck 12.

Preferably, each of the first and second support members 26 and 28 has a hollow configuration with a substantially rectangular cross-section. Further, each of the first and second support members 26 and 28 is provided with first and second ends, such as first and second ends 30 and 32, respectively, for the first support member 26 and first and second ends 34 and 36, respectively, for the second support member 28.

A movable blade means denoted in general by reference number 38 is movably mounted on the first ends 30 and 34 of the first and second support members 26 and 28. The blade means 38 functions to engage the tread 110 when it is in its extended, flat position to urge one end of the tread 110 over onto itself to form a roll, as will be described in greater detail hereafter.

Figure 2:
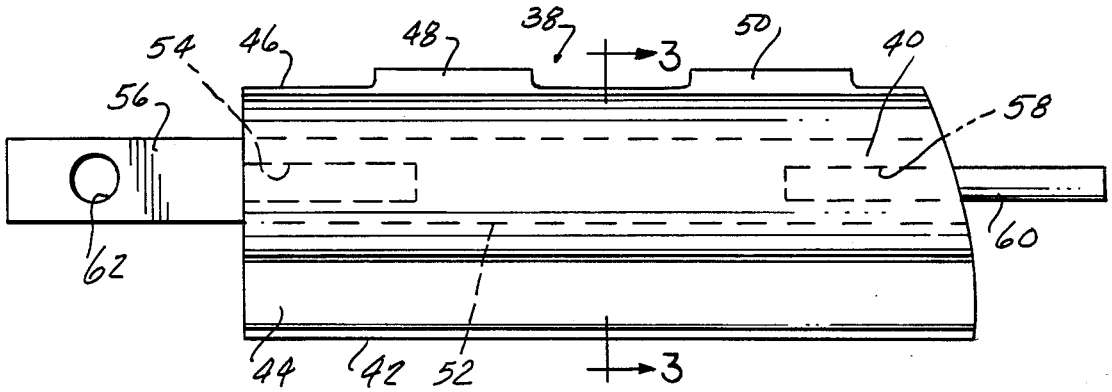
FIG. 2 is a plan view of the blade portion of the tread roller apparatus shown in FIG. 1.
Figure 3:
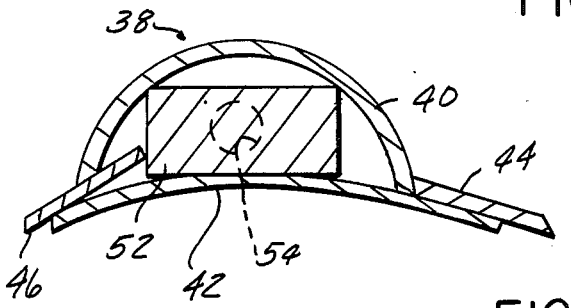
FIG. 3 is a cross-sectional view generally taken along line 3—3 in FIG. 2.
Figure 4:
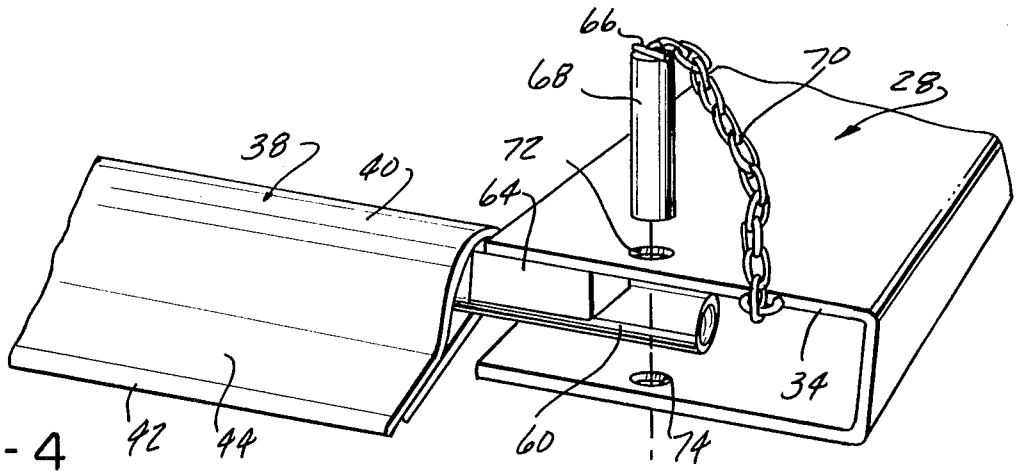
FIG. 4 is a partial, enlarged perspective view of the tread roller apparatus showing the releasable engagement of the blade with one of the support members.

As shown in FIG. 1 and in greater detail in FIGS. 2 and 3, the blade means 38 is formed with an arcuate center portion 40 in the form of a thin plate having a substantially circular configuration. A bottom plate 42 having a slightly curved form is secured, such as by welding, to the bottom edges of the center portion 40. An outwardly extending lip 44 is secured to the frontmost edge of adjoined center portion 40 and the bottom plate 42 and extends outward over the outermost edge of the bottom plate 42. A rear plate 46 is also secured to the bottom plate 42 and the center portion 40 and extends rearward from the center portion 40 as shown in FIGS. 2 and 3. The rear plate 46 is formed with two outwardly extending tabs 48 and 50.

A square or rectangular block member 52 is mounted within the center of the center portion 40 and the bottom plate 42. The block member 52 has a centrally extending bore 54 which receives a square rod 56, one end of which extends outward from one end of the center portion of the blade 38. A circular bore 58 is formed in the opposite end of the block 52 and receives a circular pin 60 which extends outward from the center portion 40 as shown in FIG. 2.

The rod 56 is provided with a through bore 62 which receives a hinge pin 63 for hingedly mounting the one end 56 of the blade 38 to the first support member 26 as shown in FIG. 1. This allows movement of the blade means 38 with respect to the support member 26. The opposite end of the blade means 38 defined by the pin 60 is releasably engagable with the other support member 28.

A block 64 is mounted at end of the support member 28 and extends downward a short distance to close off a portion of the open first end 34 of the support member 28. The block 64 releasably holds the pin 60 on the blade means 38 within the support member 28 until the weight of the tread roll urges the blade means 38 downward until the pin 60 slips below and out from behind the block 64. This permits pivotal movement of the blade 38 about the pin 63 to the extended position shown in FIG. 7.

Figure 5:
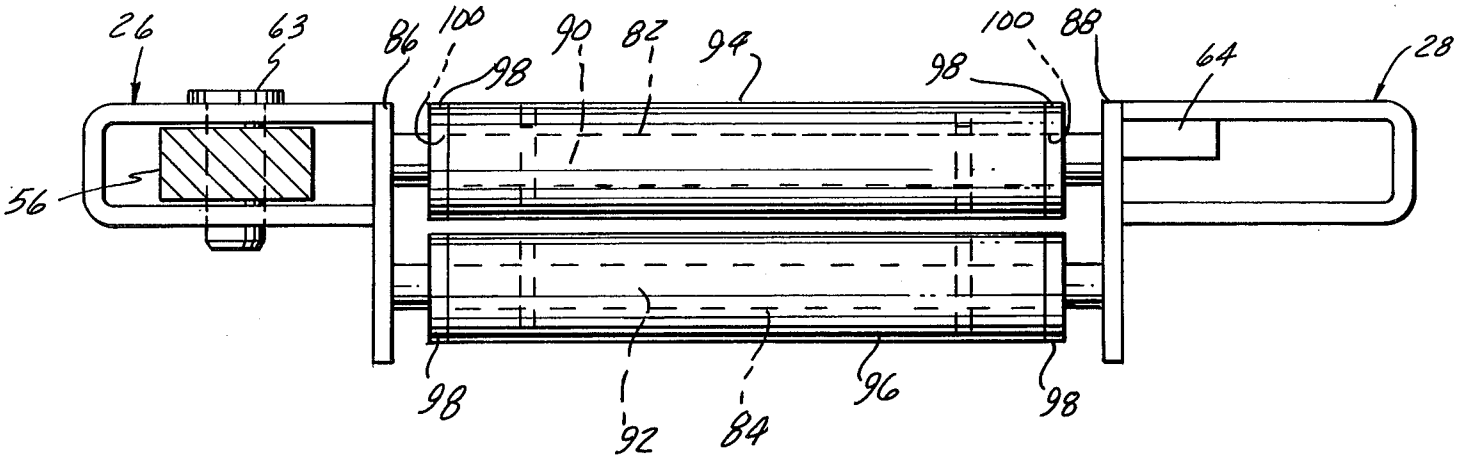
FIG. 5 is a front elevational view of the rollers employed in the tread roller apparatus of the present invention with some of the apparatus on the support members removed for clarity.

Referring now to FIG. 5, at least one and preferably two rollers 82 and 84 are mounted on the tread roller apparatus 10 between the arms 26 and 28. First and second plates 86 and 88, respectively, are secured to the innermost opposed edges of the arms 26 and 28, preferably by welding. Elongated rods 90 and 92 are secured to and extend between the plates 86 and 88. The rods 90 and 92 are vertically spaced apart and aligned in a common vertical plane. Hollow tubes 94 and 96 are mounted over the rods 90 and 92, respectively, and are secured on the rods 90 and 92 in a rotatable manner by means of end plates 98. The end plates 98 are provided with an enlarged central aperture 100 which enables the tubes 94 and 96 to rotate freely about the rods 90 and 92 and, also, to move transversely a small distance between the plates 86 and 88.

The rollers 82 and 84 are spaced rearward from the blade 38 to define a space to receive the radius of the tread roll. The rollers 82 and 84 function to assist in curling or curving the tread 110 back onto itself to form a roll.

Figure 8:
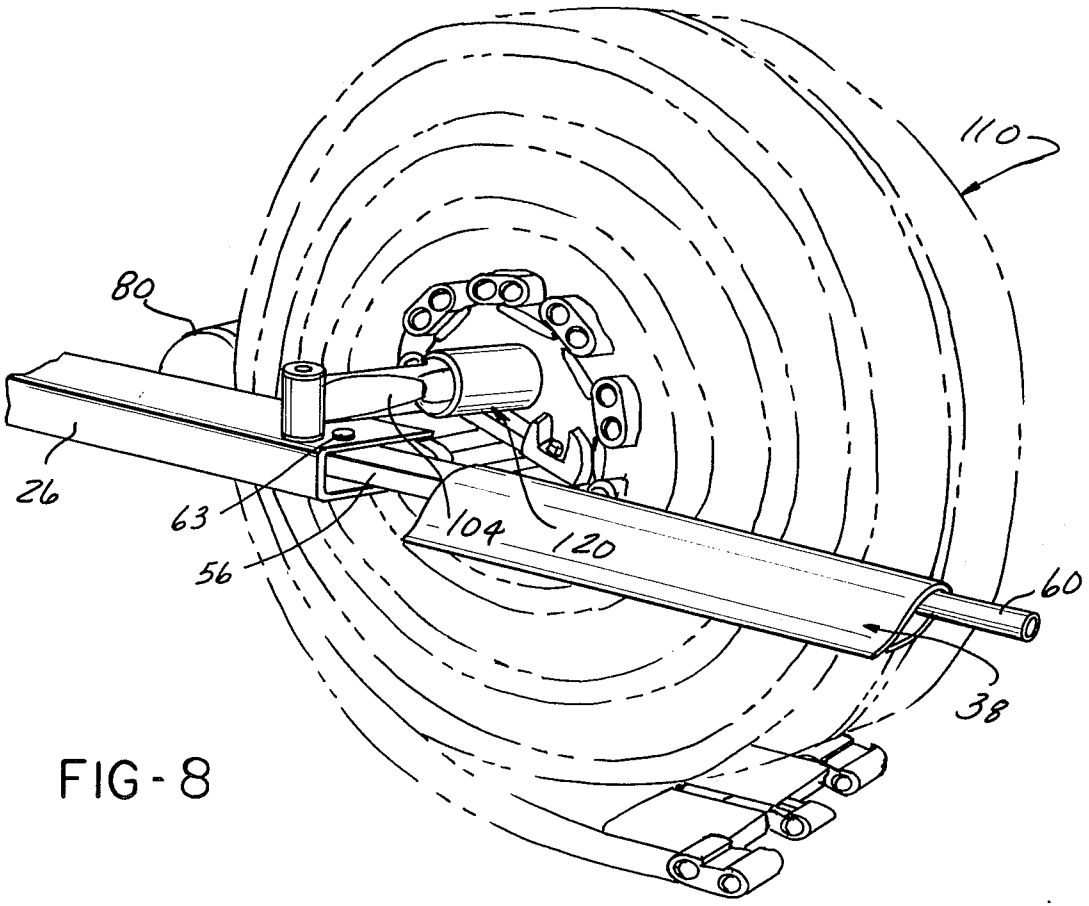
FIG. 8 is a perspective view showing the use of the tread roller apparatus of the present invention in forming a complete roll of the tread for transport.

In lieu of the two rollers 82 and 84, one roller 80 may be mounted between the arms 26 and 28 as shown in FIGS. 1, 7 and 8.

Figure 6:
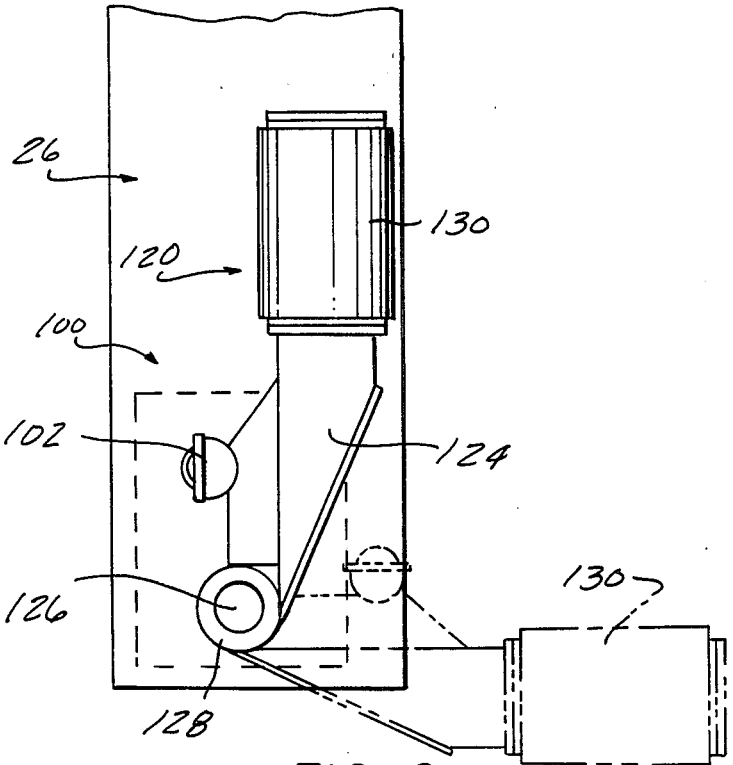
FIG. 6 is a partial, top view of one of the pin members.

As shown in FIG. 1, and in greater detail in FIG. 6, the tread roller apparatus 10 is provided with tread roll support means in the form of first and second pins 120 and 122, respectively. As both of the pins 120 and 122 are identically constructed, only one is shown in FIG. 6 and will be described herafter.

The pin 120 is provided with a first section 124 which is swingably mounted on a pivot or hinge member 128 which in turn is mounted swingably on the hinge pin 126 mounted on support member 26. A circular pin 128 is mounted at the end of the support member 26 to mount the pin 120 on the support member 26.

A circular boss 130 is formed on the end of the first section 124 and forms a base for supporting the tread roll 110 above the ground when the roll is being or has been formed.

A lock means denoted in general by reference number 100 is attached to the first section 124 of the pin 120. The lock means 100 includes a retractable pin 102 which moves in a housing attached to the first section 124. The pin 102 is removably insertable within an aperture formed in the support member 26 to lock the pin means 120 in a first position overlaying the support member 26. Upward movement on the pin 102 releases the pin means 120 from the support member 26 and enables its pivotal movement from a retracted position shown in solid outline in FIG. 6 to an extended position shown in FIG. 8 substantially perpendicular to the side walls of the support member 26. The pin means 120 and 122 when in their extended position substantially perpendicular to the support members 26 and 28 support the tread roll as it is being rolled into a roll as shown in FIGS. 7 and 8.

It will also be understood that the pins 120 and 122 may also be forwarded with sliding rather than pivotal movement between their first and second positions.

In operation, as shown in FIGS. 7 and 8, the tread roller apparatus 10 is brought into position such that the blade 38 on the support members 26 and 28 is brought into engagement with the tread 110 which causes the end of the tread 110 to curl back on itself between the blade 38 and the rollers 90 and 92 into a roll as the vehicle 12 is moved slowly forward. The rollers 90 and 92 curve the tread 110 back onto itself wherein one end of the tread 110 locks into the center guide portions 112 a roll such that continued forward movement of the vehicle 112 causes the roll to curl over itself.

The roll thus formed may be transported by raising the arms 20 and 22 on the forklift truck 12 as the roll is gradually increasing in diameter and the vehicle 12 is moved slowly forward over the tread 110. The rolled tread may then be bound at the outer end and raised a sufficient distance to enable movement of the vehicle 12 to easily transport the tread roll to any desired location, such as for storage, laying out for installation on the vehicle, etc.

In summary, there has been disclosed a unique tread roller apparatus which enables a tread for a military tank or earth moving vehicle to be formed into a roll for transport between storage and use locations. The apparatus is simple in construction and adaptable for mounting on conventional vehicles to eliminate manual labor in handling the tread and thereby providing both time and cost savings in transporting a tread between storage and use locations.

What is claimed is:

1. A tread roller apparatus for use on a vehicle comprising:

first and second arms extending outward from the vehicle and being vertically movable with respect to the vehicle, each of the first and second arms having first and second ends;

blade means, movably mounted on the first end of the first arm and releasably engagable with the first end of the second arm, for engaging the tread and causing the tread to form a roll as the vehicle is moved forward over the tread;

roller means mounted between the second ends of the first and second arms for urging the tread into a roll; and first and second pins, movably mounted on the first ends of the first and second arms, respectively, and movable between a first retracted position and a second position substantially perpendicular to the first and second arms for support the tread roll.

2. The tread roller apparatus of claim 1 further including first lock means for releasably locking the first and second pins in either of the first and second positions.

3. The tread roller apparatus of claim 1 further including second lock means for releasably locking one end of the blade within the second support arm.

4. The tread roller apparatus of claim 1 wherein the roller means comprises at least one roller spaced rearward from the blade means and adapted for turning the end of the tread over and upon itself into a roll.

5. The tread roller apparatus of claim 4 wherein the roller means comprises:

first and second vertically spaced rollers rotatably mounted between the first and second support arms.

6. The tread roller apparatus of claim 1 wherein the blade means comprises:

a center portion having a tapered, inclined front edge and two outwardly extending arms, with one end of the center portion being pivotally attached to one of the support arms and the other end being releasably engagable with the first end of the second support arm.

7. A tread rolling apparatus comprising:

a movable vehicle;

first and second support arms mounted on and extending outward from the vehicle and being vertically movable with respect to the vehicle;

blade means, movably mounted on the outer end of the first arm and releasably engagable with the outer end of the second arm, for engaging the tread and causing the tread to form a roll as the vehicle is moved forward over the tread;

roller means mounted between the inner ends of the first and second arms for urging the tread into a roll; and first and second pins, mounted on the outer ends of the first and second arms, respectively, and movable with respect to the first and second arms between a first retracted position disengaged from a tread roll and a second position substantially perpendicular to the first and second arms for supporting a tread roll disposed between the first and second support arms.

8. Apparatus for rolling up and transporting treads comprising, in combination:

a pair of arms for mounting on a vertically movable portion of a transporter vehicle in laterally spaced apart relation;

means on said arms for engaging a tread to be rolled and inducing a curl in the tread as the transporter vehicle moves along the tread and said means moving out of curl-inducing engagement with the tread as the tread roll is formed; and means on the arms for forming the tread into a multi-layered roll as the transporter vehicle continues to move along the tread after disengagement of the first mentioned means from the tread.

9. The invention defined by claim 8 wherein means are provided on the arms for engaging and supporting a rolled tread for transport by the transporter vehicle.

10. In combination with a forklift truck having a pair of vertically movable forks, tread rolling and transporting mechanism comprising:

a pair of arms engageable over the forks of the truck to extend outwardly therefrom in parallel spaced relation;

means on the outer ends of the arms for engaging the end of a tread stretched out on the ground to induce a curl in the tread as the forklift truck moves along the tread;

means on the arm spaced rearwardly from the first mentioned means to cause the tread to curl upon itself in a multi-layered roll; and means on the arms for supporting a tread roll for transport by the forklift truck.

* * * * *

UNITED STATES PATENT AND TRADEMARK OFFICE

CERTIFICATE OF CORRECTION

PATENT NO. : 4,613,094

DATED : September 23, 1986

INVENTOR(S) : WILLIAM K. SCHWEITZER

It is certified that error appears in the above-identified patent and that said Letters Patent is hereby corrected as shown below:

In Claim 1, column 5, line 27, change "support" to --- supporting --- .

In Claim 6, column 5, in the fourth line of the claim, delete "and two outwardly extending arms,".

Signed and Sealed this

Tenth Day of February, 1987

*Attest:*

*Attesting Officer*

DONALD J. QUIGG

*Commissioner of Patents and Trademarks*